US009784090B2

(12) United States Patent
Baria et al.

(10) Patent No.: US 9,784,090 B2
(45) Date of Patent: Oct. 10, 2017

(54) METHOD FOR SELECTING THE LOCATION OF A STIMULATING GEOTHERMAL WELL

(71) Applicant: ORMAT TECHNOLOGIES, INC., Reno, NV (US)

(72) Inventors: Roy Baria, Surrey (GB); Joerg Baumgaertner, Kapsweyer (DE); Ezra Zemach, Reno, NV (US)

(73) Assignee: ORMAT TECHNOLOGIES INC., Reno, NV (US)

( * ) Notice: Subject to any disclaimer, the term of this patent is extended or adjusted under 35 U.S.C. 154(b) by 0 days.

(21) Appl. No.: 14/411,753

(22) PCT Filed: Mar. 13, 2014

(86) PCT No.: PCT/IB2014/000329
§ 371 (c)(1),
(2) Date: Dec. 29, 2014

(87) PCT Pub. No.: WO2014/140752
PCT Pub. Date: Sep. 18, 2014

(65) Prior Publication Data

US 2015/0369032 A1 Dec. 24, 2015

Related U.S. Application Data

(60) Provisional application No. 61/787,328, filed on Mar. 15, 2013, provisional application No. 61/943,689, filed on Feb. 24, 2014.

(51) Int. Cl.
*E21B 47/00* (2012.01)
*E21B 43/25* (2006.01)
(Continued)

(52) U.S. Cl.
CPC ..... *E21B 47/00* (2013.01); *E21B 7/00* (2013.01); *E21B 43/25* (2013.01); *E21B 43/30* (2013.01)

(58) Field of Classification Search
CPC ..... E21B 47/00; E21B 28/00; E21B 43/25
See application file for complete search history.

(56) References Cited

U.S. PATENT DOCUMENTS 4,187,908 A 2/1980 Fertl et al.
8,347,959 B2 * 1/2013 Suarez-Rivera ..... E21B 43/17 166/250.1
(Continued)

FOREIGN PATENT DOCUMENTS

WO 2012 058027 5/2012

OTHER PUBLICATIONS

Hickman, S. H. and M. D. Zoback, The Interpretation of Hydraulic Fracturing Pressure-Time Data from In-situ Stress Determination, in Hydraulic Fracturing Stress Measurements, National Academy Press, Washington, D. C., 44-54 (1983).*
(Continued)

*Primary Examiner* — David Bagnell
*Assistant Examiner* — Brandon Duck
(74) *Attorney, Agent, or Firm* — Oblon, McClelland, Maier & Neustadt, L.L.P.

(57) ABSTRACT

The present invention provides a method for selecting the location of a stimulating well, comprising the steps of conducting a geological study of a field containing a geothermal hydrothermal resource by operating geological useful equipment, determining a maximum horizontal stress line within said field by means of a device, generating a map of existing wells including a plurality of sub-commercial wells within said field relative to said maximum horizontal stress line, measuring a distance between each of said sub-commercial wells and the maximum horizontal stress line, determining that those sub-commercial wells aligned with, or located relatively close to the maximum horizontal stress line are stimulatable, and selecting a location of a
(Continued)

stimulating well for stimulating the stimulatable well that is separated less than an anticipated fracture propagating distance from said stimulatable well.

3 Claims, 3 Drawing Sheets

(51) Int. Cl.
*E21B 7/00* (2006.01)
*E21B 43/30* (2006.01)

(56) References Cited

U.S. PATENT DOCUMENTS

| | | | |
|---|---|---|---|
| 2009/0065253 | A1 | 3/2009 | Suarez-Rivera et al. |
| 2009/0242198 | A1 | 10/2009 | Evans et al. |
| 2012/0325462 | A1 | 12/2012 | Roussel et al. |
| 2013/0062054 | A1 | 3/2013 | Jo |
| 2013/0211807 | A1* | 8/2013 | Templeton-Barrett .. E21B 43/26 703/10 |

OTHER PUBLICATIONS

International Search Report Issued Aug. 27, 2014 in PCT/IB14/00329 Filed Mar. 13, 2014.
Schochet et al, "A Step Toward EGS Commercialization in the Basin and Range", Geothermal Resources Council Transactions, vol. 26, Sep. 22-25, 2002, pp. 251-254.
Robertson-Tait et al, "Progress and Future Plans at the Desert Peak East EGS Project", Geothermal Resources Council Transactions, vol. 27, Oct. 12-15, 2003, pp. 871-877.
Lutz et al, "Geologic Characterization of Pre-Tertiary Rocks at the Desert Peak East EGS Project Site", Churchill County, Nevada, Geothermal Resources Council Transactions, vol. 27. Oct. 2-15, 2003, pp. 865-870.
Robertson-Tait et al, "Selection of an Interval For Massive Hydraulic Stimulations In Well DP 23-1, Desert Peak East EGS Project", Nevada, Twenty-Ninth Workshop on Geothermal Reservoir Engineering, Stanford University, Stanford, California, Jan. 26-28, 2004. pp. 1-6.
Lutz et al, "Stratigraphic Relationships In Mesozoic Basement Rocks At The Desert Peak East EGS Area". Nevada, Twenty-Ninth Workshop on Geothermal Reservoir Engineering, Stanford University; Stanford, California; Jan. 26-28, 2004. pp. 1-9.
Robertson-Tait et al, "The Desert Peak East EGS Project: A Progress Report". World Geothermal Congress 2005, Antalya, Turkey, Apr. 24-29, 2005. pp. 1-7.
Kratt et al, "Spectral Analyses of Well Cuttings from Drillhole DP23-1, Desert Peak EGS Area, Nevada—Preliminary Study of Minerals and Lithologies by Infrared Spectrometry", Geothermal Resources Council Transactions, vol. 28, Aug. 29-Sep. 1, 2004. pp. 473-476.
Carlson et al, "Fracture Permeability Evolution in Rock from the Desert Peak EGS Site", Geothermal Resources Council Transactions, vol. 28, Aug. 29-Sep. 1, 2004. pp. 279-284.
Lutz et al, "Geological and Structural Relationships in the Desert Peak Geothermal System. Nevada: Implications for EGS Development", Thirty-Fourth Workshop on Geothermal Reservoir Engineering, Stanford University, Stanford, California, Feb. 9-11, 2009. pp. 1-10.
Robertson-Tait et al, "Progress on the Desert Peak East EGS Project", GRC Transactions, vol. 29. 2005. pp. 117-124.
Davatzes et al, "Fractures, Stress and Fluid Flow Prior To Stimulation of Well 27-15, Desert Peak, Nevada, EGS Project", Thirty-Fourth Workshop on Geothermal Reservoir Engineering, Stanford University, Stanford, California, Feb. 9-11, 2009. pp. 1-11.
Kovac et al, "Borehole Image Analysis and Geological Interpretation of Selected Features in Well DP 27-15 at Desert Peak, Nevada: Pre-Stimulation Evaluation of an Enhanced Geothermal System", Thirty-Fourth Workshop on Geothermal Reservoir Engineering, Stanford University, Stanford, California, Feb. 9-11, 2009. pp. 1-5.
Zemach et al, "Feasibility Evaluation of an "In-Field" EGS Project at Desert Peak", Nevada, GRC Transactions, vol. 33, 2009. pp. 285-295.
Rose et al, "Tracer Testing at the Desert Peak EGS Project", GRC Transactions, vol. 33, 2009, pp. 241-244.
Hickman et al, "In-Situ Stress and Fracture Characterization For Planning of an EGS Stimulation in the Desert Peak Geothermal Field", Nevada; Thirty-Fifth Workshop on Geothermal Reservoir Engineering, Stanford University, Stanford, California, Feb. 1-3, 2010. pp. 1-13.
Zemach et al, "Feasibility of an "In-Field" EGS Project" at Desert Peak, Nevada, USA, World Geothermal Congress 2010, Bali, Indonesia, Apr. 25-29, 2010. pp. 1-10.
Chabora et al, "Hydrauiic Stimulation of Well 27-15, Desert Peak Geothermal Field", Nevada, USA, Thirty-Seventh Workshop on Geothermal Reservoir Engineering, Stanford University, Stanford, California, Jan. 30-Feb. 1, 2012. pp. 1-12.
Stacey et al, "EGS Stimulation of Well 27-15, Desert Peak Geothermal Field", Nevada, GRC Transactions, vol. 34, 2010, pp. 451-455.
Sanyal et al, "Injection Testing for an Enhanced Geothermal System Project" at Desert Peak, Nevada, Geothermal Resources Council Transactions, vol. 27, Oct. 12-15, 2003. pp. 685-891.

* cited by examiner

METHOD FOR SELECTING THE LOCATION OF A STIMULATING GEOTHERMAL WELL

FIELD

The present invention relates to the field of geothermal energy. More particularly, the invention relates to a method for selecting the location of a stimulating well.

BACKGROUND

In geothermal power plants, hot fluid from a geothermal resource is extracted via a production well from the interior of the earth to the ground surface. The extracted hot fluid is used for power production either directly when converted to steam and expanded in a turbine, or indirectly by means of a binary cycle power plant whereby the extracted hot fluid is brought in heat exchanger relation with the motive fluid of the power plant, such as organic motive fluid. The heat depleted geothermal liquid is returned to the interior of the earth via an injection well, which is separated from the production well to avoid mixing of the hot fluid that is extracted in the production well. The injected geothermal liquid becomes reheated and is returned to the production well via a rock fracture.

As a result of continuous exploitation of the geothermal resource, the enthalpy of the extracted fluid, and/or pressure tends to decrease over the course of time, reducing the economic viability of a power plant for producing power from the extracted geothermal resource. Such production wells consequently cease to be exploited for power production, and are hereafter referred to as "sub-commercial" wells. These sub-commercial wells render much financial damage to developers of the geothermal power plant after investing a significant amount of capital in drilling and maintaining the well.

Attempts have been made to improve the productivity of a sub-commercial well by a stimulation method.

U.S. 2012/0181034 discloses a method for stimulating an underground reservoir formation by introducing a particulate diverting agent into a well, to thereby temporarily seal passages within a fracture near the wellbore face and to isolate the fracture from the well. When a stimulation fluid is applied to the well at a sufficient pressure, an additional fracture is produced by hydroshearing such that it is expanded under shear. Rather than causing permanent damage to the permeability of the fractures which will lead to a reduction in economic value of the geothermal resource, the particulate diverting agent is able to degrade over an extended time.

One disadvantage of this stimulation method relates to its unpredictability since it is unknown where the induced fracture will be produced and whether the induced fracture will lead to stimulation of the sub-commercial well.

It is therefore an object of the present invention to provide a method for selecting a location of a stimulating well from where there exists a high probability that an induced fracture will lead to stimulation of a sub-commercial well.

Other objects and advantages of the invention will become apparent as the description proceeds.

SUMMARY

The present invention provides a method for selecting the location of a stimulating well, comprising the steps of conducting a geological study of a field containing a geothermal hydrothermal resource, determining a maximum horizontal stress line within said field by means of a device, generating a map of existing wells including a plurality of sub-commercial wells within said field relative to said maximum horizontal stress line, measuring a distance between each of said sub-commercial wells and said maximum horizontal stress line, determining that those sub-commercial wells aligned with, or located relatively close to said maximum horizontal stress line are stimulatable, and selecting a location of a stimulating well for stimulating said stimulatable well that is separated less than an anticipated fracture propagating distance from said stimulatable well.

The present invention is also directed to a method for improving the productivity of a geothermal field in a hydrothermal resource, comprising the steps of conducting a geological study of a geothermal field containing a resource, determining a maximum horizontal stress line within said field by means of a device, generating a map of existing wells including a plurality of sub-commercial wells within said field relative to said maximum horizontal stress line, measuring a distance between each of said sub-commercial wells and said maximum horizontal stress line, determining that those sub-commercial wells aligned with, or located relatively close to said maximum horizontal stress line are stimulatable, selecting a location of a stimulating well for stimulating said stimulatable well that is separated less than an anticipated fracture propagating distance from said stimulatable well, and injecting stimulation fluid into said stimulating well.

DETAILED DESCRIPTION

Over the course of time, the productivity of a production well supplying geothermal fluid to be extracted tends to decline, due to depletion of the geothermal resource or clogging of a fracture extending to the production well. In order to increase the productivity of the production well, a new well may be drilled within a field containing the resource at a location which is relatively close to the resource. The newly drilled well (hereinafter the "stimulating well") is caused to be partially isolated, so that stimulation fluid injected through the well will flow only through a zone that is not isolated to hydraulically produce a fracture at a desired depth. The newly produced fracture may extend from the stimulating well to the production well, enabling additional geothermal fluid to be in fluid communication therewith and to thereby increase the productivity of the production well.

Figure 1:
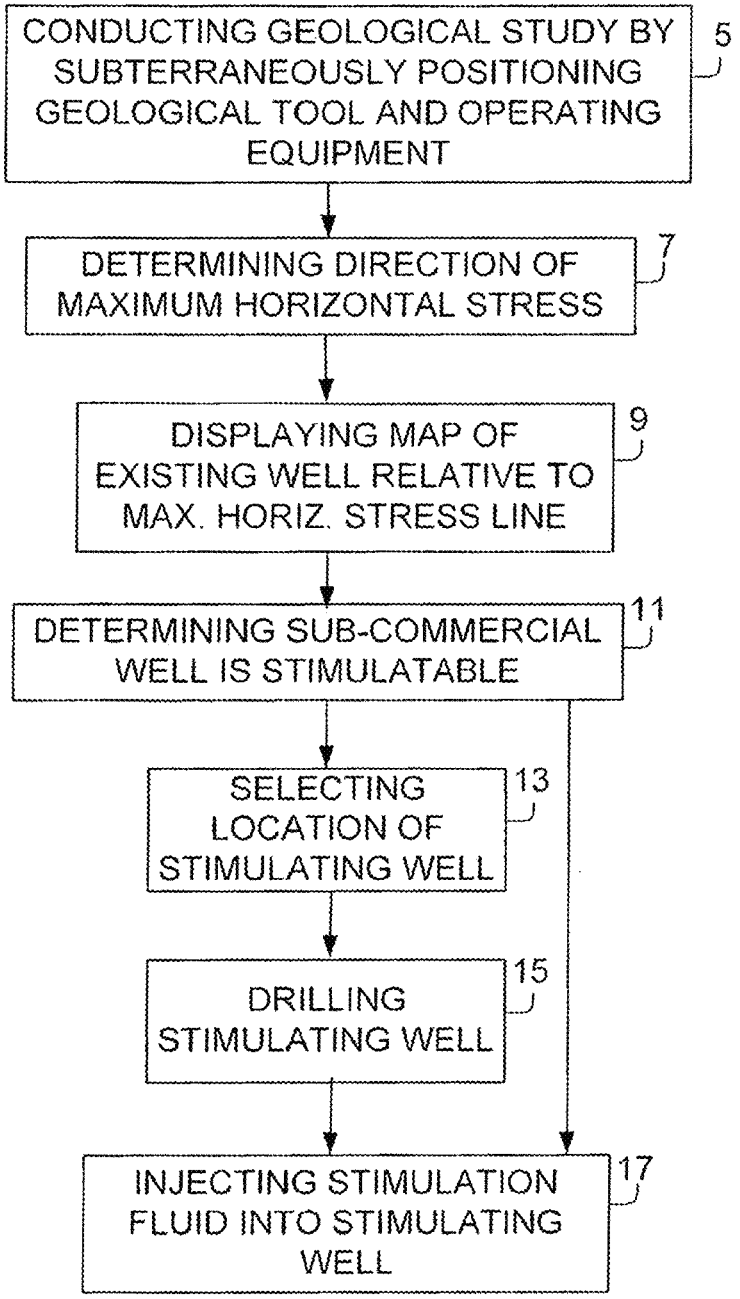
FIG. 1 is a method for selecting the location of a stimulating well, according to one embodiment of the present invention.

Reference is now made to FIG. 1, which illustrates a method for selecting the location of a stimulating well, according to one embodiment of the present invention. In order to determine the location at which a stimulating well is to be drilled, a geological study is first made of the field in step 5. In particular, an in-situ stress regime is determined within the field by operating geologically useful equipment, in order to generate pertinent data relating to the nature of the field and to thereby provide the flow distribution of the geothermal resource within the field. During the geological study, the location of existing wells within the field is also determined as the stress regime is influenced by the presence of the wells.

A geothermal field is generally in a state of compressive stress equilibrium prior to drilling a well. The three mutually perpendicular principal stresses that exist during equilibrium are a vertical stress and two horizontal stresses. If the magnitudes of the two horizontal stresses are different, one type of stress is referred to as the minimum horizontal stress and the other as the maximum horizontal stress.

For the purposes of the present invention, the magnitudes of horizontal stresses are of importance since a horizontal stress magnitude at a specific depth helps to define characteristics of the rock formation at the field. These horizontal stresses have been attributed to plate tectonics. Without being bound to any theory, fluids prefer to flow along fractures oriented along, or near to, the direction of maximum horizontal stress since these fractures are subjected to the lowest normal stresses and therefore provide the least resistance to flow.

Many ways have been suggested to determine the direction of maximum stress, including a leak off test for determining the injected fluid pressure at which rock strain becomes substantial and analysis of seismic data. Any known method for determining the maximum stress direction is within the scope of the present invention.

After the direction of maximum horizontal stress within the field is determined in step 7, a map of the field is generated in step 9 whereby a line of the maximum horizontal stress as well as the location of existing wells within the field is displayed. This map may be generated by one or more devices and executable instructions or software code obtainable from a readable medium that includes but is not limited to hard drive media, optical media, EPROM, EEPROM, tape media, cartridge media, flash memory, ROM, and memory stick, or communicated via a data signal from a server or any other remote device in communication with a suitable data network such as the Internet. Alternatively, the map is manually generated.

When one of the existing wells is sub-commercial, a determination is made whether it is worthy to be stimulated, for example by the executable instructions or software code. Such a well will be called a "stimulatable well". A sub-commercial well aligned with, or located relatively close to, the maximum horizontal stress line is determined to be stimulatable in step 11 since there exists a high probability that an induced fracture will propagate along the maximum horizontal stress line to the stimulatable well, leading to the stimulation of a sub-commercial well. On the other hand, a sub-commercial well significantly distanced from the maximum horizontal stress line will be disregarded and considered unworthy of being stimulated since it cannot be connected to the induced fracture.

The stimulatable well is stimulated by selecting in step 13, for example by executable instructions or software code, a location on the line of maximum horizontal stress that is separated less than an anticipated fracture propagating distance from the stimulatable well, depending for example on rock strength parameters, pressure of the stimulation fluid, and magnitude of the maximum horizontal stress, drilling the stimulating well at the selected location in step 15, and injecting the stimulation fluid into the stimulating well in step 17 to induce or open a fracture. Alternatively, one of the existing wells can be used as a stimulating well if it is located on the line of maximum horizontal stress and separated less than the anticipated fracture propagating distance from the stimulatable well.

Figure 2:
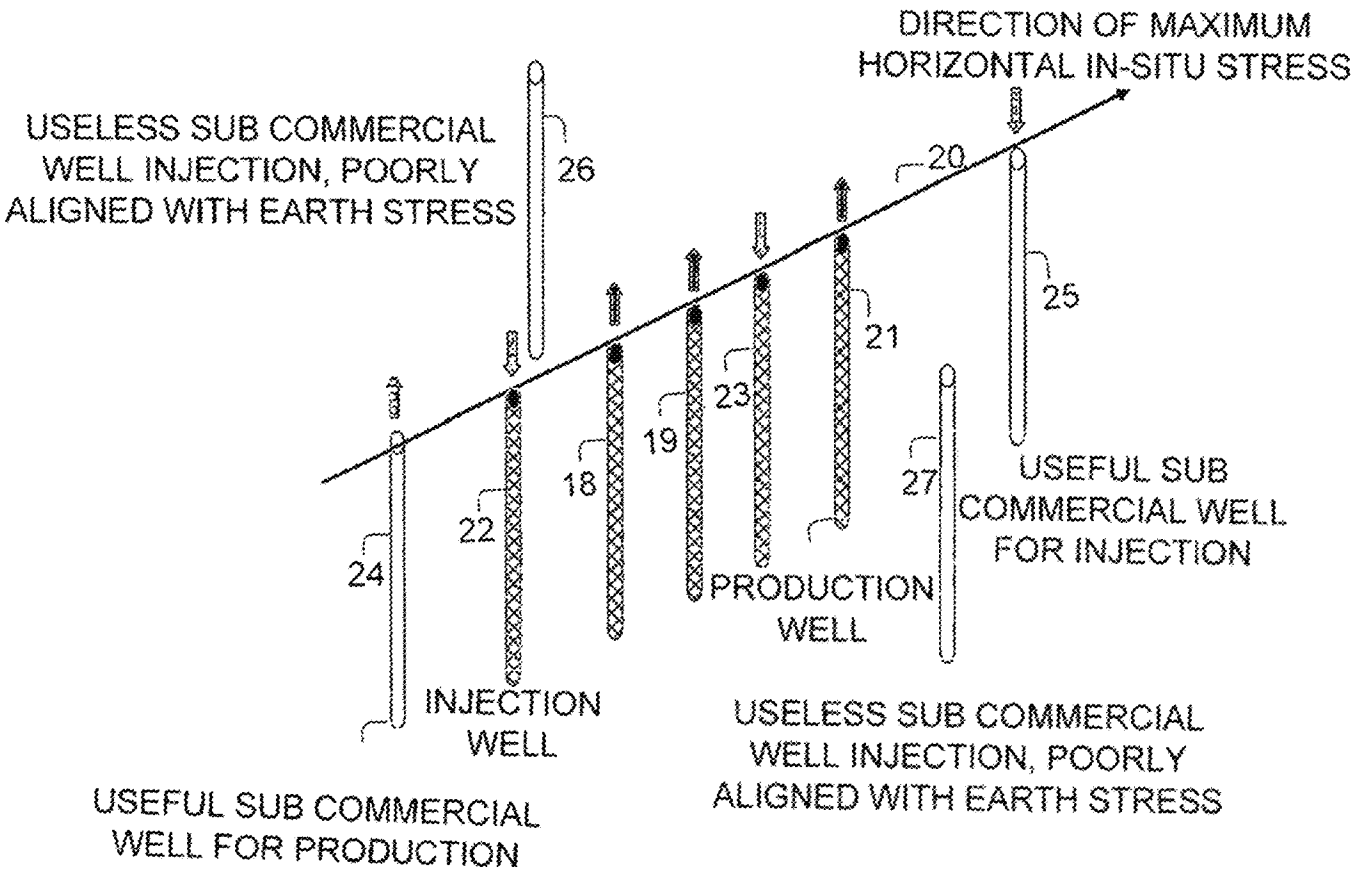
FIG. 2 schematically illustrates a process for determining whether a sub-commercial well is stimulatable.

FIG. 2 schematically illustrates the process for determining whether a sub-commercial well is stimulatable. The generated maximum horizontal stress line 20 is displayed together with existing wells 18-19 and 21-27. For the production of power in conjunction with a geothermal power plant, production wells 18-19 and 21 and injection wells 22-23 are used. Among the sub-commercial wells 24-27, wells 26 and 27 are not stimulatable since they are significantly distanced from maximum horizontal stress line 20. Well 24 is stimulatable since it is separated less than the anticipated fracture propagating distance from the stimulating well 22 functioning as an injection well. Sub-commercial well 25 can also add to the economic vitality of the power plant by functioning as a stimulating well since it is separated less than the anticipated fracture propagating distance from the production well 21.

When a fracture is induced by the stimulation fluid, a hydrological connection is made between the fracture and a subterranean permeable region not intersected by a well, facilitating an increase in the amount of fluid that can be reinjected into the field, an increase in the amount of geothermal fluid extractable by a production well, and an increase in the amount of electricity produced by the existing power plant.

Figure 3:
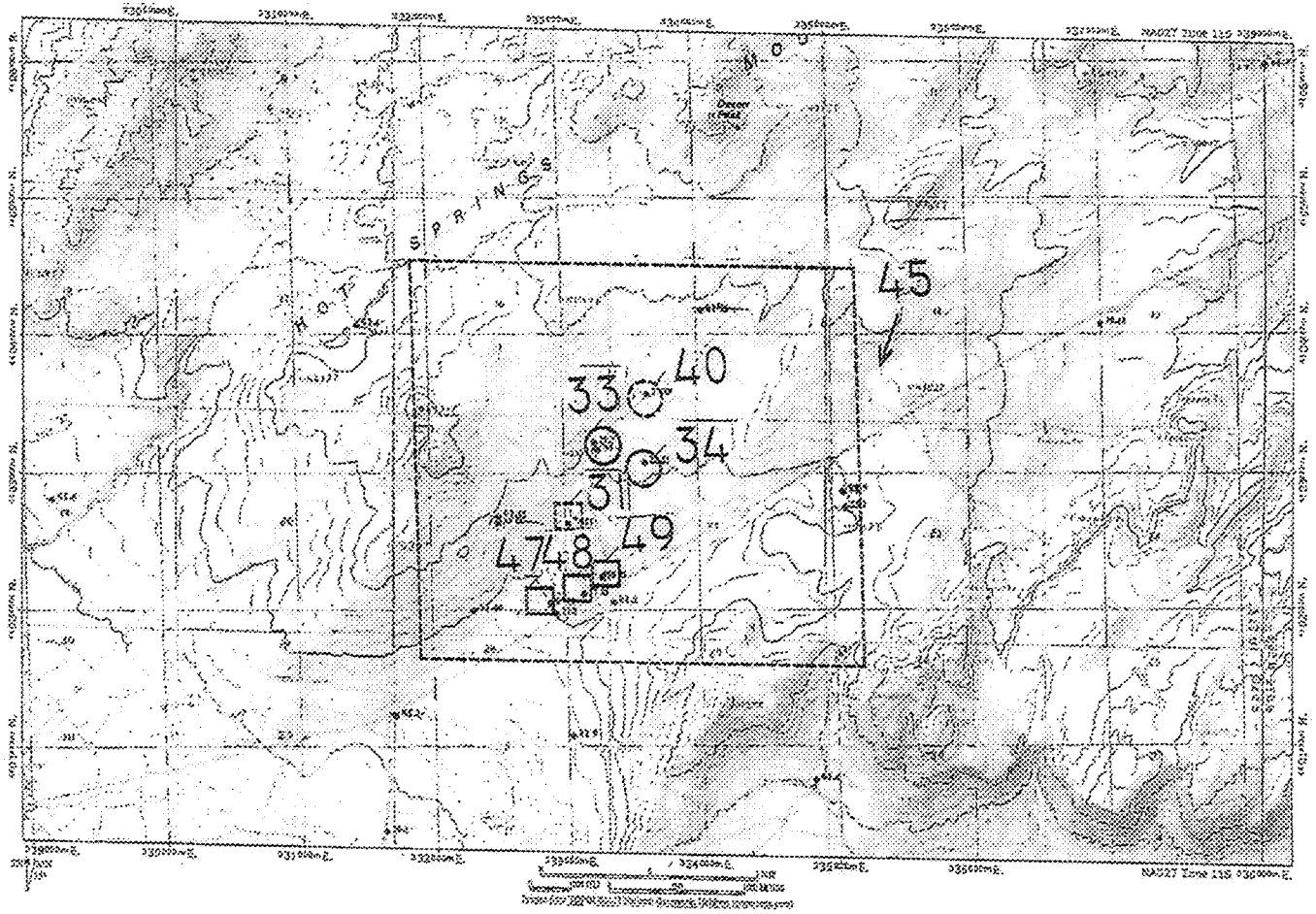
FIG. 3 is a schematic plan view of a field containing a geothermal resource, illustrating the relative location of a stimulating well for inducing or opening a fracture in an adjoining rock formation.

An exemplary geothermal field is illustrated in FIG. 3. In field 45 located at the Desert Peak geothermal reservoir, Nevada, USA, four artesian production wells three of which 47-49 are shown for producing two-phase geothermal fluid containing steam and liquid, three pumped production wells, one of which 31 is shown for producing geothermal brine, and injection wells 33-34 have been in use for producing power by means of a binary cycle power plant. The outlet of production wells 31 and 47-49 are in fluid communication with two flash separators, to ensure that the separated geothermal steam and liquid are suitably delivered to the power plant. Stimulating well 40 is drilled in the vicinity of injection wells 33-34 so that the induced or opened fracture will be connected to existing fractures through which geothermal fluid is flowable to one or more of the production wells. By drilling stimulating well 40 through which geothermal fluid is injectable, the total power capacity of the power plant can be considerably increased, for example from about 13 MW to about 15 MW.

It will be appreciated that the stimulating well can also be a production well. After a fracture is induced or opened thereby, the fracture will receive geothermal fluid from an injection well or from another fracture, in order to bypass a clogged production well.

Stimulating well may be isolated in several ways or methods, or a fracture may be induced or opened in several ways or methods.

Although the foregoing description was made with respect to wells drilled in a geothermal field, the method of the present invention is equally applicable to a maximum horizontal stress line found in other geological formations, such as a petrochemical field.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A method for selecting the location of a stimulating well, comprising the steps of:

conducting a geological study of a field containing a geothermal hydrothermal resource by determining a maximum horizontal stress line within said field by means of a device, generating a map of existing wells including a plurality of sub-commercial wells within said field relative to said maximum horizontal stress line, measuring a distance between each of said sub-commercial wells and said maximum horizontal stress line, determining that those sub-commercial wells aligned with, or located relatively close to said maximum horizontal stress line are stimulatable, and selecting a location of a stimulating well for stimulating said stimulatable well, that is separated by less than an anticipated fracture propagating distance from said stimulatable well.

2. A method for improving the productivity of a geothermal field in a hydrothermal resource, comprising the steps of:

conducting a geological study of a geothermal field containing a resource by operating geological equipment, determining a maximum horizontal stress line within said field by means of a device, generating a map of existing wells including a plurality of sub-commercial wells within said field relative to said maximum horizontal stress line, measuring a distance between each of said sub-commercial wells and said maximum horizontal stress line, determining that those sub-commercial wells aligned with, or located relatively close to said maximum horizontal stress line are stimulatable, selecting a location of a stimulating well for stimulating said stimulatable well, which location is separated by less than an anticipated fracture propagating distance from said stimulatable well, and injecting stimulation fluid into said stimulating well.

3. The method according to claim 2, wherein the stimulating well is drilled within the field after its location is selected.

* * * * *